US006880302B1

(12) United States Patent
Fontaine

(10) Patent No.: US 6,880,302 B1
(45) Date of Patent: Apr. 19, 2005

(54) ELEMENTS OF STRETCHED FALSE CEILING, USE OF SAME FOR PRODUCING FALSE WALLS AND FALSE CEILINGS

(75) Inventor: Marc Fontaine, Haubourdin (FR)

(73) Assignee: Newmat, SA, Haubourdin (FR)

( * ) Notice: Subject to any disclaimer, the term of this patent is extended or adjusted under 35 U.S.C. 154(b) by 0 days.

(21) Appl. No.: 09/979,246

(22) PCT Filed: May 20, 2000

(86) PCT No.: PCT/FR00/00683

§ 371 (c)(1),
(2), (4) Date: Mar. 28, 2002

(87) PCT Pub. No.: WO01/71117

PCT Pub. Date: Sep. 27, 2001

(51) Int. Cl.[7] ..... E04B 9/00

(52) U.S. Cl. ..... 52/222; 52/273; 52/506.05; 52/506.08; 160/371

(58) Field of Search ..... 52/222, 273, 506.01, 52/506.05, 506.08, 511, 63; 160/327, 328, 371

(56) References Cited

U.S. PATENT DOCUMENTS

| | | | | | |
|---|---|---|---|---|---|
| 1,772,780 | A | * | 8/1930 | Milone | 160/395 |
| 2,310,127 | A | * | 2/1943 | Smith | 160/19 |
| 3,205,628 | A | | 9/1965 | Frisk et al. | |
| 3,341,013 | A | * | 9/1967 | Moulton | 209/403 |
| 3,405,489 | A | | 10/1968 | Frisk et al. | |
| 3,424,179 | A | * | 1/1969 | Minot | 135/129 |
| 3,798,865 | A | * | 3/1974 | Curtis | 52/665 |
| 3,898,782 | A | * | 8/1975 | Donato | 52/506.08 |
| 4,026,081 | A | * | 5/1977 | Delaney et al. | 52/222 |
| 4,053,008 | A | * | 10/1977 | Baslow | 160/327 |
| 4,083,157 | A | | 4/1978 | Anthonioz | |
| 4,281,875 | A | * | 8/1981 | Manzoni | 297/440.22 |
| 4,408,433 | A | | 10/1983 | Scherrer | |

(Continued)

FOREIGN PATENT DOCUMENTS

| | | |
|---|---|---|
| DE | 26 59 722 | 7/1978 |
| EP | 0 043 466 | 6/1981 |
| EP | 0 089 905 | 3/1983 |
| EP | 0 136 954 | 4/1985 |
| EP | 0 215 715 | 9/1986 |
| EP | 0 281 468 | 2/1988 |
| EP | 0 338 925 | 4/1989 |
| EP | 0 504 530 | 3/1991 |
| EP | 0 588 748 | 9/1993 |
| EP | 0 643 180 | 5/1994 |

(Continued)

*Primary Examiner*—Brian E. Glessner
(74) *Attorney, Agent, or Firm*—Ladas & Parry LLP

(57) ABSTRACT

The invention concerns a false wall element comprising a stretched fabric in a frame with lateral edge provided with means catching the edges of said fabric, said lateral edge comprising a rigid profiled section forming a free edge curved in the plane, with curvature corresponding to that of a part of the edge of said fabric fastened on said curved edge. Said false wall elements are used for making curved stretched suspended false ceilings and stretched false walls with curved profile.

17 Claims, 10 Drawing Sheets

U.S. PATENT DOCUMENTS

| | | | | | |
|---|---|---|---|---|---|
| 4,586,841 | A | * | 5/1986 | Hunter | 403/230 |
| 4,641,987 | A | * | 2/1987 | Schlegel | 403/169 |
| 4,663,911 | A | * | 5/1987 | Gracia | 52/506.06 |
| 4,674,213 | A | * | 6/1987 | Keithley | 40/603 |
| 4,711,060 | A | | 12/1987 | Scherrer | |
| 4,835,914 | A | | 6/1989 | Scherrer | |
| 5,029,422 | A | * | 7/1991 | Scherrer | 52/222 |
| 5,058,340 | A | * | 10/1991 | Muller | 52/222 |
| 5,154,031 | A | * | 10/1992 | Wall | 52/506.06 |
| 5,242,004 | A | * | 9/1993 | Stilling | 160/57 |
| 5,413,300 | A | * | 5/1995 | Hosteing | 248/317 |
| 5,572,844 | A | * | 11/1996 | Stackenwalt et al. | 52/506.07 |
| 6,438,921 | B1 | * | 8/2002 | Moore | 52/655.1 |

FOREIGN PATENT DOCUMENTS

| | | |
|---|---|---|
| EP | 0 652 339 | 10/1994 |
| FR | 1 287 077 | 4/1961 |
| FR | 1 303 930 | 10/1961 |
| FR | 1 315 219 | 4/1963 |
| FR | 1 475 446 | 4/1966 |
| FR | 2 002 261 | 10/1969 |
| FR | 2 078 579 | 2/1971 |
| FR | 2 106 407 | 9/1971 |
| FR | 2 145 147 | 4/1972 |
| FR | 2 175 854 | 3/1973 |
| FR | 2 202 997 | 10/1973 |
| FR | 2 270 407 | 3/1974 |
| FR | 2 310 450 | 5/1975 |
| FR | 2 475 093 | 2/1980 |
| FR | 2 486 127 | 7/1980 |
| FR | 2 523 622 | 3/1982 |
| FR | 2 524 922 | 4/1982 |
| FR | 2 531 012 | 7/1982 |
| FR | 2 537 112 | 12/1982 |
| FR | 2 552 473 | 9/1983 |
| FR | 2 561 690 | 3/1984 |
| FR | 2 587 392 | 9/1985 |
| FR | 2 587 447 | 9/1985 |
| FR | 2 592 416 | 12/1985 |
| FR | 2 597 906 | 4/1986 |
| FR | 2 611 779 | 2/1987 |
| FR | 2 619 531 | 8/1987 |
| FR | 2 623 540 | 11/1987 |
| FR | 2 624 167 | 12/1987 |
| FR | 2 627 207 | 2/1988 |
| FR | 2 630 476 | 4/1988 |
| FR | 2 645 135 | 3/1989 |
| FR | 2 658 849 | 2/1990 |
| FR | 2 685 036 | 12/1991 |
| FR | 2 691 193 | 5/1992 |
| FR | 2 692 302 | 6/1992 |
| FR | 2 695 670 | 9/1992 |
| FR | 2 699 211 | 12/1992 |
| FR | 2 699 613 | 12/1992 |
| FR | 2 688 849 | 2/1993 |
| FR | 2 703 711 | 4/1993 |
| FR | 2 707 708 | 7/1993 |
| FR | 2 712 006 | 11/1993 |
| FR | 2 712 325 | 11/1993 |
| FR | 2 699 209 | 12/1993 |
| FR | 2 727 711 | 12/1994 |
| FR | 2 734 296 | 5/1995 |
| FR | 2 736 615 | 7/1995 |
| FR | 2 751 682 | 7/1996 |
| FR | 2756 600 | 12/1996 |
| FR | 2 767 851 | 8/1997 |
| FR | 2 753 218 | 3/1998 |
| GB | 1067530 | 3/1967 |
| GB | 1150225 | 4/1969 |
| GB | 1214421 | 12/1970 |
| GB | 1323532 | 7/1973 |
| WO | WO 92/18722 | 10/1992 |
| WO | WO 94/12741 | 6/1994 |

* cited by examiner

ELEMENTS OF STRETCHED FALSE CEILING, USE OF SAME FOR PRODUCING FALSE WALLS AND FALSE CEILINGS

BACKGROUND OF THE INVENTION

The invention relates to the technical field of false ceilings and taut false walls.

In the prior art, there already exist a large number of embodiments of these false ceilings.

By way of example, reference can be made to the patent applications in France published under the following numbers: 2 767 851, 2 751 682, 2 734 296, 2 712 006, 2 707 708, 2 703 711, 2 699 211, 2 699 209, 2 695 670, 2 691 193, 2 688 849, 2 685 036, 2 645 135, 2 630 476, 2 627 207, 2 624 167, 2 623 540, 2 619 531, 2 597 906, 2 611 779, 2 592 416, 2 587 447, 2 561 690, 2 587 392, 2 552 473, 2 537 112, 2 531 012, 2 524 922, 2 475 093, 2 486 127, 2 523 622, 2 310 450, 2 270 407, 2 202 997, 2 175 854, 2 145 147, 2 106 407, 2 078 579, 2 002 261, 1 475 446, 1 303 930, 1 287 077.

For examples, reference can also be made to the following documents: U.S. Pat. No. 5,058,340; U.S. Pat. No. 4,083,157; U.S. Pat. No. 4,083,157; EP-A-643 180, EP-A-652 339, EP-A-588 748, EP-A-504 530, EP-A-338 925, EP-A-281 468, EP-A-215 715, EP-A-089 905, EP-A-043 466, WO-A-94/12741, WO-A-92/18722.

It is also possible to consult by way of example the following patent applications in France of the Applicant: 736 615, 2 756 600, 2 727 711, 2 712 325, 2 699 613, 2 695 670, 2 692 302, 2 658 849.

Known materials of the prior art for embodying taut false ceilings or taut false walls are most often polymer materials provided with a large number of qualities, such as in particular fire resistance, impervious to air and thus be impervious to dust or humidity, and facility of maintenance.

False ceilings obtained with the aid of these materials can incorporate insulating materials, spotlights or various lighting, as well as ventilation or aeration openings or sprinklers.

As they can be dismantled, intervention can be effected in the plenum.

Polymer materials for known taut ceilings in the prior art, which may be translucent or opaque, possibly fully tinted, mat, lacquered, marbled, suede or velvet-finished, can therefore be used in an industrial environment, a hospital environment, for collective equipment, laboratories or dwellings.

The lacquered finish makes it possible to have a mirror effect often implemented in commercial centres, a relatively mat finish approaching a plaster aspect being more usual in traditional decors.

In a former technique, the fabrics or top sheets at the ceiling or at a wall being definitively fixed by means of points or staples.

Conventional taut false ceilings currently include firstly, a horizontal frame secured to the upper portion of the walls of a room, this frame being an external heald formed by butt-jointed sectional bars;

secondly, a lap stretched horizontally inside this frame.

This disposition enables elements at the taut ceiling to be dismantled.

Supporting of the lap with respect to the heald frame is obtained by various means, several examples being given below.

According to a first type of embodiment, the heald includes a U-shaped throat limited by two walls, one of the two walls having a lip orientated towards the bottom of the throat, hooks placed on the circumference of the lap being firmly anchored on this lip.

For this first type of embodiment, reference can be made to the document FR-A-1 303 930.

According to a second type of embodiment, the heald includes a U-shaped throat limited by two walls, one of the two walls including a shoulder having one portion situated towards the bottom of the throat forming a stop.

For this second type of embodiment, reference can be made to the documents FR-A-1 475 446 and FR-A-2 002 261.

According to a third type of embodiment, the heald is a flat profile, the lap being squeezed between this profile and the wall on which it is fixed.

For this third type of embodiment, reference can be made to for example the document FR-A-2 734 296.

According to a fourth type of embodiment, the heald is provided with means forming tension and fitting pliers.

For this fourth type of embodiment, reference can be made for example to the documents FR-A-2 699 211 and FR-A-2 537 112.

According to a fifth type of embodiment, the heald is provided with a throat in which hook-shaped elements integral with the lap can be gripped in the way of a harpoon.

For this fifth type of embodiment, reference can be made for example to the documents FR-A-2 630 476 and EP-A-388 925.

In frames of taut ceilings of the prior art, regardless of the means for retaining tension of the lap on the heald frame. (stop, cramp irons, forked ties, clamping, catching . . . ), the healds are normally made of an extruded polymer material.

For the most part, taut ceilings are moreover mounted with their lap fully taut.

In certain particular embodiments with the lap being taut on a horizontal heald frame secured to the walls of a room, deformations of the taut lap are embodied, as described in the documents FR-A-1 515 260 and EP-A-281 468.

Thus, the document EP-A-281 468 describes a false ceiling comprising a taut lap hooked along its edges to a horizontal support frame constituted by butt-jointed profile bars fixed to the walls of a room. Above the lap, means are placed exerting on the lap on at least one point an adjustable force provoking its deformation. These means include a cable moving through a pulley fixed to the ceiling of a room, said cable supporting a heavy weight on the lap.

BRIEF SUMMARY OF THE INVENTION

So as to fit out extremely large areas, such as commercial galleries, airports, factories and warehouses, the inventors have noticed that users, architects and stylists would respond favourably to the offer of taut false ceilings with aspects more varied than those currently available to relieve the monotony of conventional taut false ceilings or suspended false ceilings.

One of the aims of the invention is to provide new taut ceiling structures responding to this application, these taut ceiling structures making it possible to obtain laps of taut fabrics, possibly flat, whose edges are not formed solely or mainly of linear segments, but may include or be formed solely of predetermined curved, convex or concave segments.

To achieve these ends, the invention relates according to a first aspect to a false partition element including a taut fabric in a side border frame provided with means for hooking the edges of said fabric, said side border of the frame including a rigid profile forming a curved inward free edge inside the plane with a curve corresponding to that of a portion of the edge of said fabric hooked onto this free curved inward edge of the frame.

This false partition element has the following characteristics, possibly combined, according to various embodiments:

- the side edge of the frame is formed by assembling edge to edge the two extremities of a single profiles including a curved section, for example having a circular or elliptic shape. As a variant, especially for large frames, the side edge of said frame is formed by assembling edge to edge at least two profiles, at least one of the latter including a curved section, for example with the shape of an arc of a circle or ellipse;
- the side edge of said frame is formed by profiles made of a material selected from the group including metal alloys, especially aluminium or magnesium alloys, polymer materials or composite materials;
- the side border profiles of the frame include a main wall, this main wall supporting several projections orientated towards the inside of said frame, namely: an extreme top sole and, starting from this extreme top sole to move to the opposing extremity of said profiles, firstly projections defining insertion rails by sliding of plates inside the frame, and secondly at last one projection for hooking the side edge of the taut fabric.

In certain embodiments, the frame includes rails forming braces mounted approximately perpendicular to the profiles forming its lateral edge.

The frame includes also if appropriate side rails, the unit constituted by the rails and side rails forming a trellis, said rails comprising for example openings through which said side rails pass.

The lateral edge profiles of the frame include a projection orientated towards the inside of the frame, this projection being able to support the lateral extremities of the rails or side rails, the rails and side rails extending to a height ht lower than that hp of the profiles so as to be hidden from view after placing the fabric.

Stiffening means are mounted on the trellis of the rails and side rails and on an upper extremity sole of the frame border profiles, these stiffening means being slanted with respect to the extension plane of the fabric.

These stiffening means are selected from the group including bracket girders, turnbuckles, tightening turnbuckles or any other equivalent element.

The lateral edge of said frame is formed of profiles including a main wall on which extend in the direction of the inside of the frame from one edge to another of the profiles: an upper extreme sole; a first L-shaped projection when viewed as a cross section, this projection forming along with the main wall a support groove with an opening orientated towards the upper extreme sole; a second projection approximately perpendicular to the main wall; a third L-shaped projection when viewed as a cross section; a fourth T-shaped projection when viewed as a cross section, this fourth projection including a wall approximately perpendicular to the main wall and a wall approximately parallel and opposite the main wall; and a fifth projection forming a support groove for hooking means integral with the circumference of the fabric.

Said upper extreme sole includes a projection approximately parallel to the main wall and distant from this wall by a value e approximately equal to the opening of the support groove, this arrangement allowing the sliding mounting on the profile of plates whose thickness of its edges being less than or equal to e, these plates at least partially marrying the internal shape of the profiles between the extreme upper sole and the support groove.

The wall of the fourth projection is provided with a rib distanced from the main wall with a value e' approximately equal to the opening of the groove defined by the third projection, this arrangement allowing the sliding mounting on the profile of plates whose edge thickness is less than or equal to e', these plates partially at least marrying the internal shape of the profiles between the wall and the groove.

The plates inserted in the housings are able respectively to form a support for the rails or side rails and a linking element between the extreme portions of two continuous profiles of the frame.

The fabric is made of a material selected from the group including woven or non-woven textile fibres, polymer films, especially polyvinyl chloride, polyvinylidene chloride, this fabric being possibly provided with ink jet digital printing or silk screen printing, micro perforations or an anti-reverberating surface coating so as to improve its acoustic properties.

According to a second characteristic, the invention concerns the application of a false partition element as described above as a building suspended false ceiling element, linking means linking the frame to the ceiling of the building.

According to a third characteristic, the invention concerns the application of a false partition element as described above as a false wall element of a building, linking means linking the frame of the element to a wall of said building.

In one embodiment, the linking means are able to ensure a rigid mounting of the false partition element on the building structure.

As a variant or in combination, the linking means are able to ensure a mounting of the false partition element on the structure of the building in which the average distance between the frame of the false partition element and the wall opposite the building is able to be adjusted if required, the linking means being in particular telescopic.

According to a fourth characteristic, the invention concerns false ceilings including at least two false partition elements as described above.

In one embodiment, a portion of the lateral border of the frame of at least one of the false partition elements is placed opposite and fixed against a building wall.

BRIEF DESCRIPTION OF THE SEVERAL VIEWS OF THE DRAWINGS

Other aims and advantages of the invention shall appear on reading the following description of embodiments with reference to the accompanying drawings on which.

DETAILED DESCRIPTION OF THE INVENTION

Figure 1A:
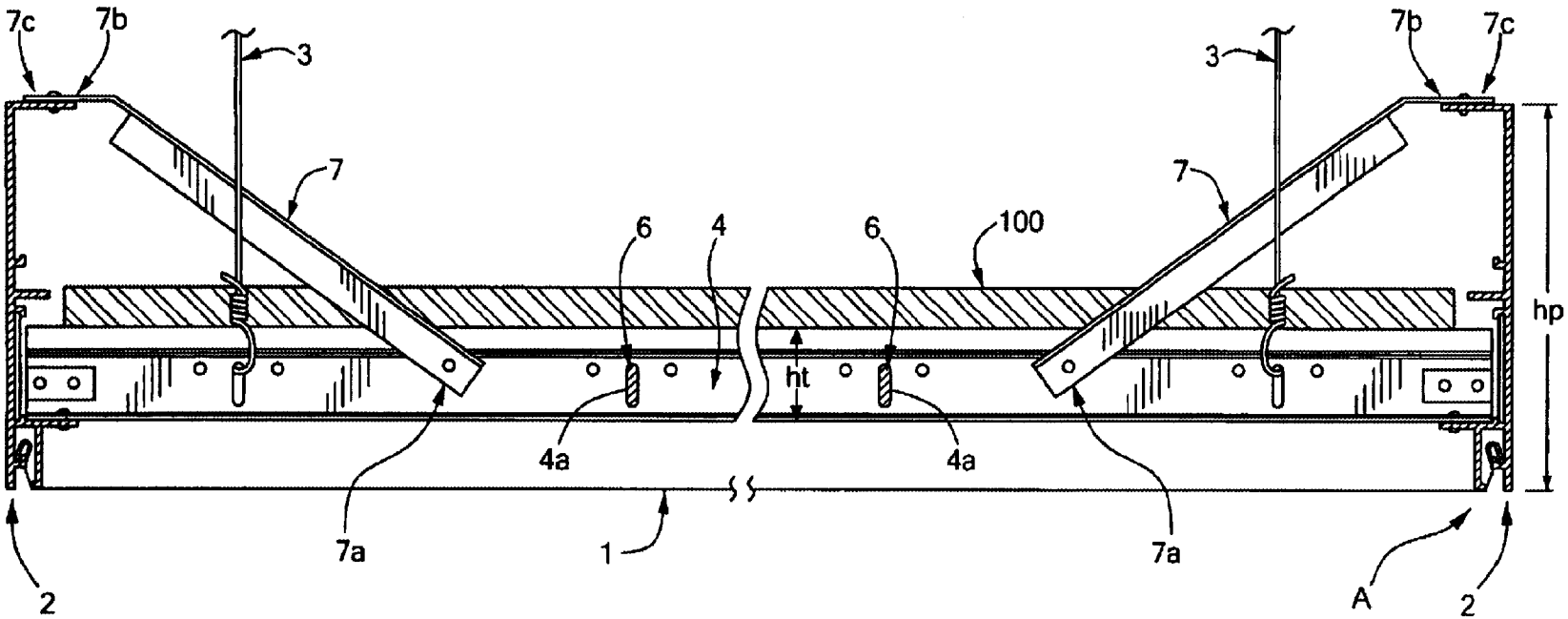
FIG. 1A is a cutaway view of a suspended false ceiling element with a taut fabric according to the invention.
Figure 1B:
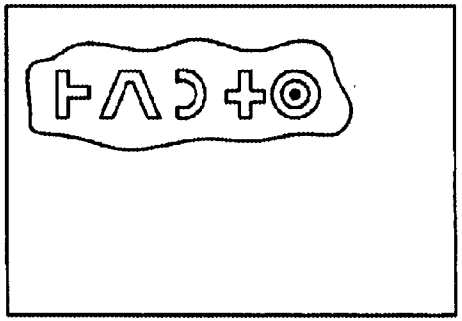
FIG. 1B is a detailed face-on view of exemplary printing on the taut fabric of figure

Reference is first made to FIG. 1A.

FIG. 1A shows a suspended taut fabric ceiling structure including a fabric 1 tensioned in a frame 2, this frame being suspended by cables 3 from a building structure (not shown). As previously noted, some embodiments of the present invention include linking means that link the frame to a ceiling or wall of a building. Cables 3 are one example of this linking means.

In certain embodiments, the cables 3 have approximately identical lengths.

In other embodiments, the cables have different lengths, the frame 2 being slanted with respect to the building structure on which it is suspended.

Figure 2A:
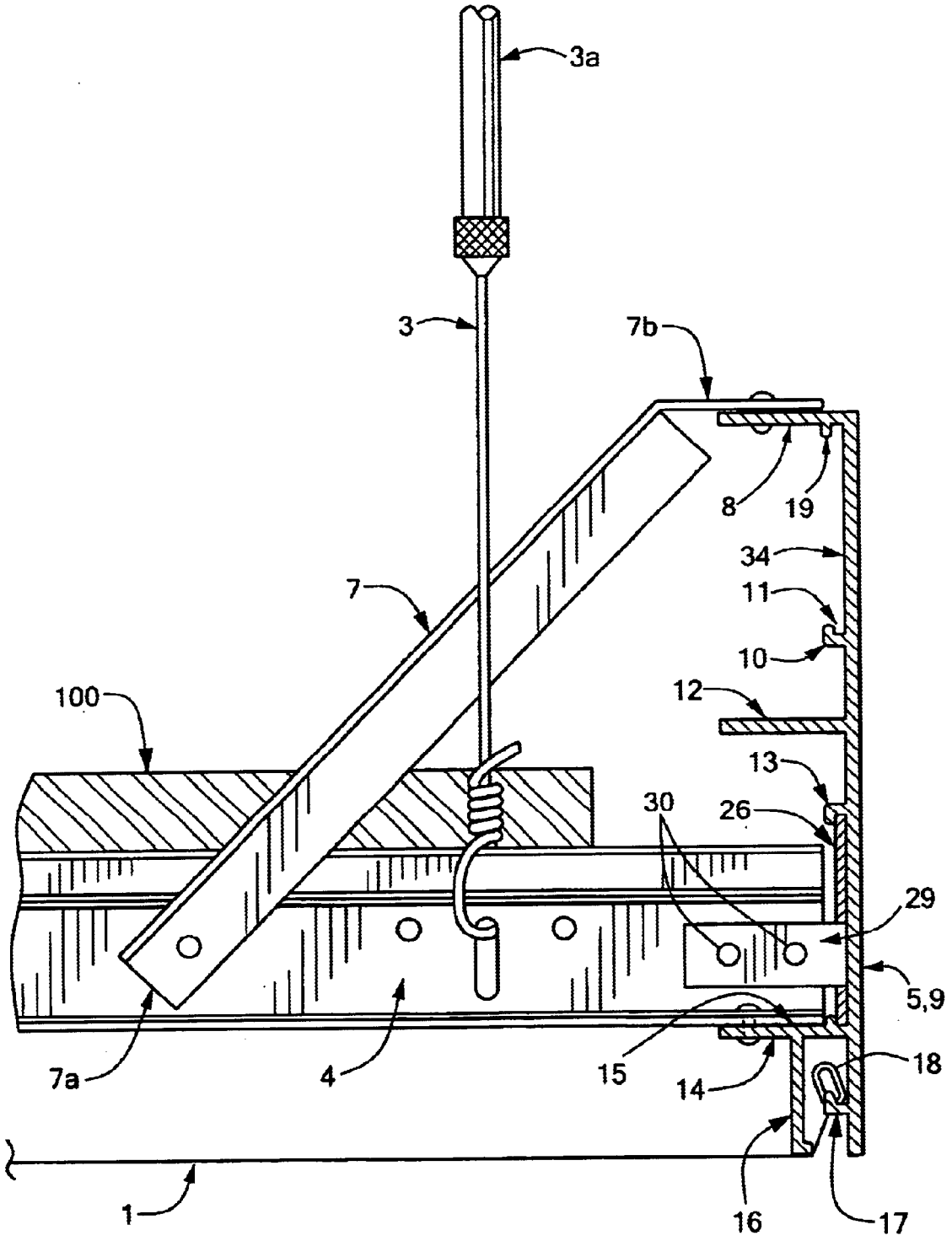
FIG. 2A is a detailed view along the narrow A of FIG. 1A.
Figure 2B:
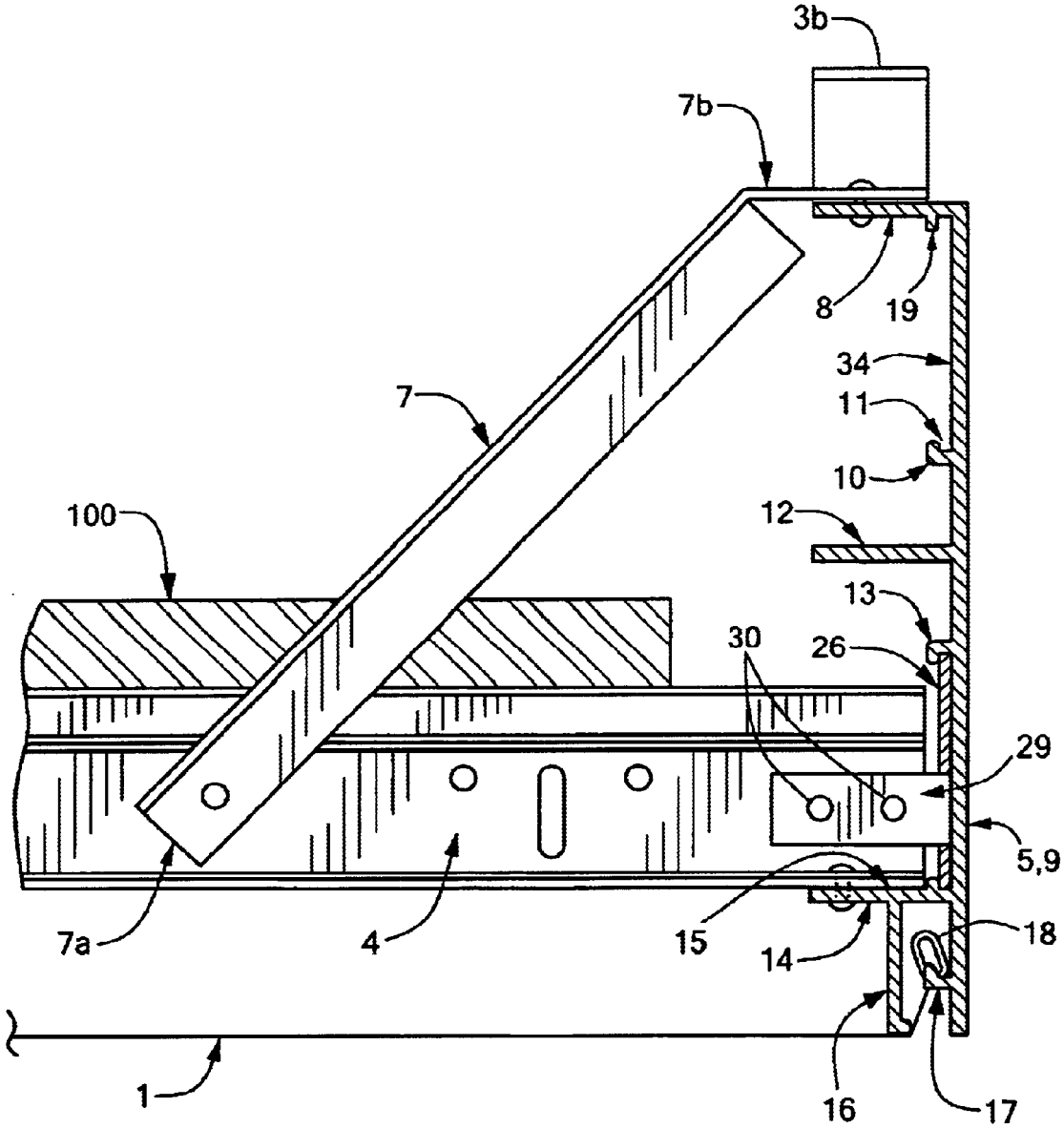
FIG. 2B is an alternate detailed view along the arrow A of FIG. 1A.

In yet other embodiments, the cables are adjustable. For example, they can be adjusted by a telescopic mechanism 3*a* shown in FIG. 2.

In yet other embodiments, the cables are adjustable. For example, they can be adjusted by a telescopic mechanism 3*a* shown in FIG. 2A. Alternatively, the frame 2 may be rigidly affixed to a wall, ceiling or other structure by the attachment bracket 3*b* shown in FIG. 2B.

As shall appear clearly to a man skilled in the art, the taut fabric structure in the frame 2 could be placed opposite a surface differing from a ceiling, such as a wall, rigid linking means allowing the frame 2 to be fixed, possibly reversible, onto the wall.

For the sake of simplification, in the rest of this description mention shall only be made of one placing of the frame 2 with respect to a ceiling surface.

The fabric 1 can be made of a material selected from the group including woven or non-woven textile fibres, polymer films, especially polyvinyl chloride and polyvinylidene chloride.

When this fabric 1 is made of a polymer material, it can be:

provided with an ink jet digital printing or silk screen printing, for example as shown at 102 in FIG. 1A;

translucent or opaque, possibly fully tinted so as to have a wide variety of tints;

provided with a mat, lacquered, marbled, suede or velvet finish;

provided with a flocking to give it a velvet or woven aspect. The surface of the fabric is for example then coated with a suitable adhesive for finely cut textile fibres, the fibres of the flock being applied by sieving and picking or by under pressure projection or even by electrostatic means when a high density of fibres is desired;

provided with perforations, micro perforations or an anti-reverberation surface coating so as to improve its acoustic properties.

When this taut fabric is made of a polymer material, its thickness is normally between 1/10 mm and several millimeters.

The fabric kept tensioned in the frame 2 can be embodied by an assembly of several breadths, possibly identical, especially as regards their colours, tints, surface aspect, finishing, printings and dimensions.

Thus for example, several polymer sheet breadths with different tints and widths can be assembled by butt welding so as to form a monochrome image inside the frame 2.

Spot light chairs, sprinkler passages or conventional pipe passages can be placed by conventional means through the taut fabric 1.

The edges of this taut fabric 1 are provided with first retention means complementary to second retention means placed on an extreme portion of the profiles forming the frame 2.

Several examples of these retention means shall be described subsequently.

There now follows first of all a description of the frame 2.

Figure 1C:
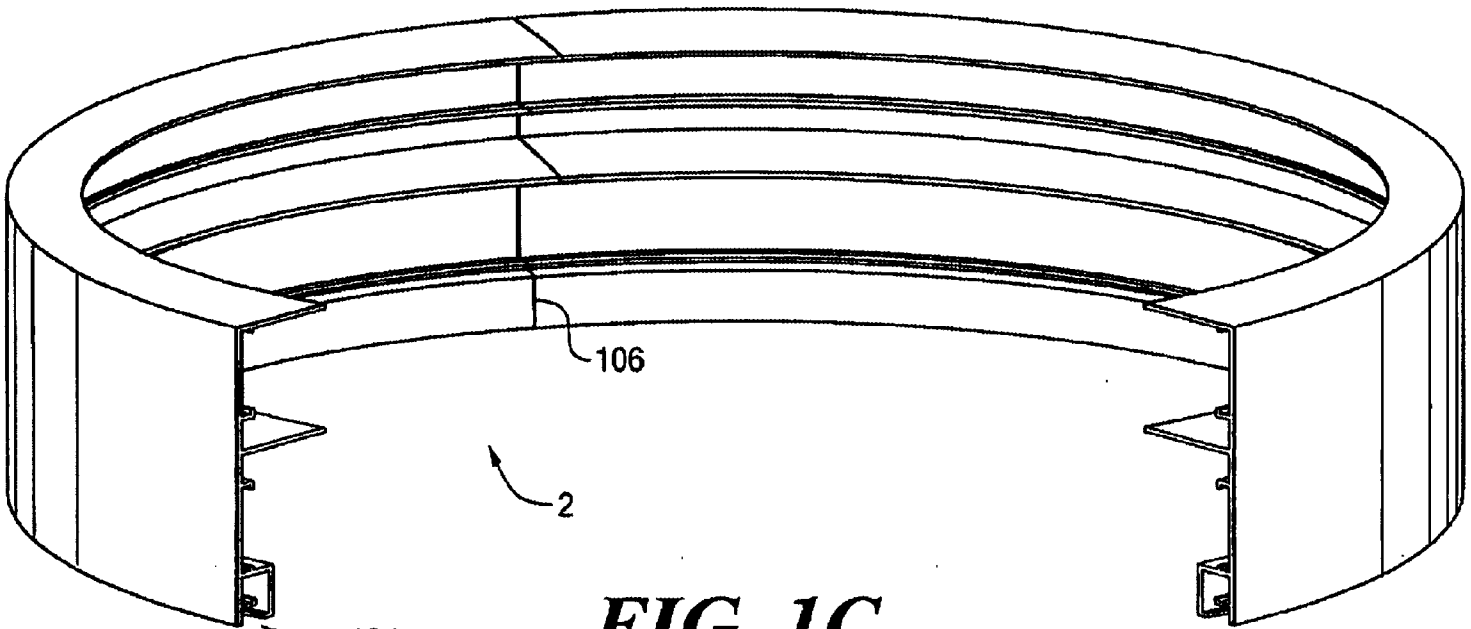
FIG. 1C is a cutaway view of a curved frame, according to one embodiment of the present invention.

As shown in FIG. 1C, in one embodiment, a curved lateral edge 104 of this frame 2 is formed by bending or curving a single profile and butt welding 106 one end of the profile to its other end, i.e. butt welding the extremities of the profile to each other.

This profile includes at least one curved section. For example, this profile has a circular or elliptical shape.

Figure 1D:
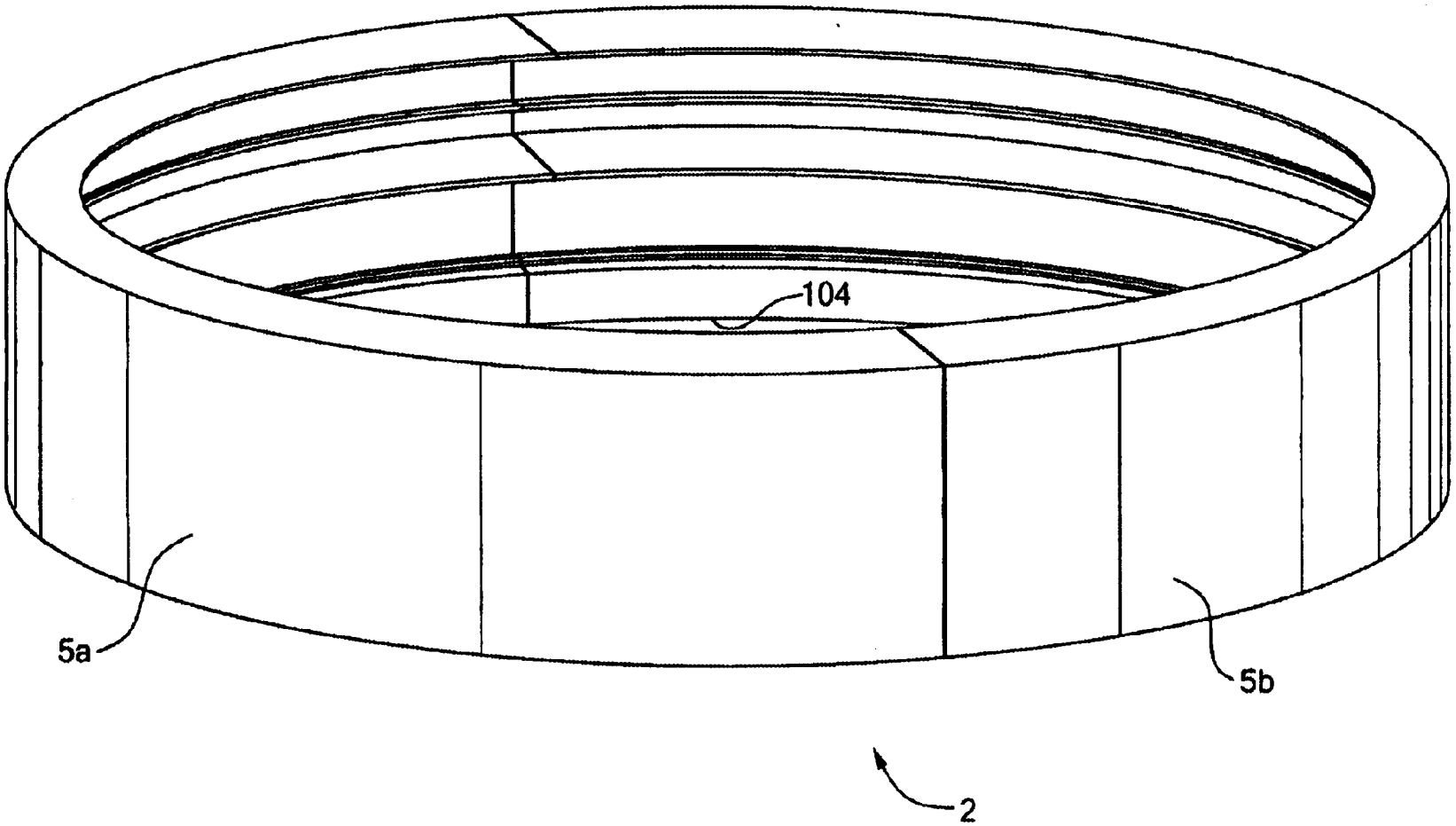
FIG. 1D is a detailed view of a curved frame, according to another embodiment of the present invention.

In other embodiments, as shown in FIG. 1D, the lateral edge 104 of this frame 2 is formed by butt joining at least two approximately identical profiles 5*a* and 5*b*. At least one of these profiles includes at least one curved section. For example, said profile is in the shape of an arc of a circle or ellipse.

The profiles forming the lateral edge of the frame are approximately rigid so as to be able to keep the fabric 1 tensioned without undergoing any significant deformation.

These profiles can be made of a material selected from the group including metal alloys, especially aluminium or magnesium alloys, polymer materials and composite material.

When these profiles are made of a metal alloy, the embodying of the frame curved section can be obtained by mechanical curving according to one embodiment, or even by moulding.

Mechanical curving has the advantage of making it possible to embody a wide variety of curves without changing tools.

If required, a surface coating can be effected on at least the external face of the profiles. This surface coating could enable the tint of the frame 2 to be coordinated with the tints of the fabric 1, for example by painting or anodisation of aluminium profiles. This surface coating can also reinforce protection against corrosion when the frame 2 needs to be placed in a potentially aggressive environment. For example, the mounted frame unit 2 can be hot galvanised prior to placing the fabric.

So as to reinforce the rigidity of the frame 2 and its dimensional stability, rails 4 and side rails 4*a* forming braces can be placed, especially when the frame is large.

In the embodiment shown on FIG. 1A, rails 4 are mounted approximately perpendicular to the profiles 5 forming the lateral edge of the frame 2, these rails 4 including openings 6 through which the side rails 4*a* pass.

The assembly formed by the rails 4 and side rails 4*a* forms a trellis, for example a square or rectangular mesh truss.

This trellis extends up to a height ht lower than that hp of the profiles 5 so as to be hidden from view after placing of the fabric 1.

The rails and side rails may for example by H or I girders, possibly alveolar, T bars of the type used for certain suspended ceilings, these being assembled together by welding or any other equivalent method.

The trellis of the rails and side rails form in certain embodiments a support for various types of equipment, such as:

acoustic absorption material (for example slabs or rock wool laps or glass fibres);

lighting systems;

ventilation systems;

aeration systems;

acoustic chambers;

sprinklers.

When lighting systems are placed, the taut fabric can be illuminated from above, this taut fabric being for example perforated or translucent. In other embodiments, the taut fabric is provided with at least one light source passage (spotlights . . . ), this fabric being reinforced by Forex washers or any other equivalent reinforcement element.

Struts 7 are assembled at their first extreme portion 7*a* to the trellis of the rails and side rails by being screwed onto the rails 4 as shown on FIG. 1A.

These struts 7 are mounted at their second extreme portion on an upper extremity sole 8 of the profiles 5, for example by welding, riveting, bolting, glueing or any other equivalent means.

In the embodiment shown on FIG. 1A, these struts 7 are extended at their second extreme portion 7*b* by a plate 7*c* intended to come plumb with and opposite the upper sole 8 and by assembled with it by riveting.

The struts 7 are slanted by an angle of about approximately 30° with respect to the extension plane of the fabric 1 in the embodiment of FIG. 1A.

If the selected height hp of the profiles is extremely large, especially for aesthetic reasons, the struts 7 could be fixed at their second extreme portion 7*b* to a projection placed on the internal face of the profiles 5 below the upper extremity sole 8.

In certain embodiments (not shown), in addition to or in the absence of the struts 7, turnbuckles or tightening turnbuckles or any other adjustable tensioning device for connect the rails and/or the side rails of the trellis with respect to the profiles 5.

Reference is now made to FIG. 2 being a detailed view of FIG. 1A along the arrow A.

The lateral border profiles 5 of the frame 2 include a main wall 9 approximately perpendicular to the upper extreme sole 8 and having an approximately flat external surface.

This external surface 9*a* may in a variant not be flat, but comprise vertical ribs, grooves, streaks.

The main wall 9 of profiles 5 can be perforated for in particular aesthetic reasons.

This main wall 9 includes several internal projections, namely starting from the upper extreme sole 8 and going towards the lower extreme edge:

a first L-shaped projection 10 when seen as a cross section and forming with the main wall 9 a support groove 11 having an opening orientated towards the upper extreme sole 8;

a second projection 12 approximately perpendicular to the main wall;

a third L-shaped projection 13 when viewed as a cross section;

a fourth T-shaped projection 14 when seen as a cross section, this fourth projection 14 including a wall 15 approximately perpendicular to the main wall 9 and a wall 16 approximately parallel and opposite the main wall 9;

a fifth projection 17 forming a support groove for hooking means 18 integral with the circumference of the fabric 1.

The upper extreme sole 8 includes a projection 19 approximately parallel to the main wall 9 and distant from this wall by a value e approximately equal to the opening of the support groove 11.

This arrangement allow the sliding mounting on the profile 5 of plates whose edges have a thickness less than or equal to e, these plates at least partly marrying the internal shape of the profiles 5 between the upper extreme sole 8 and the support groove 11.

Figure 6D:
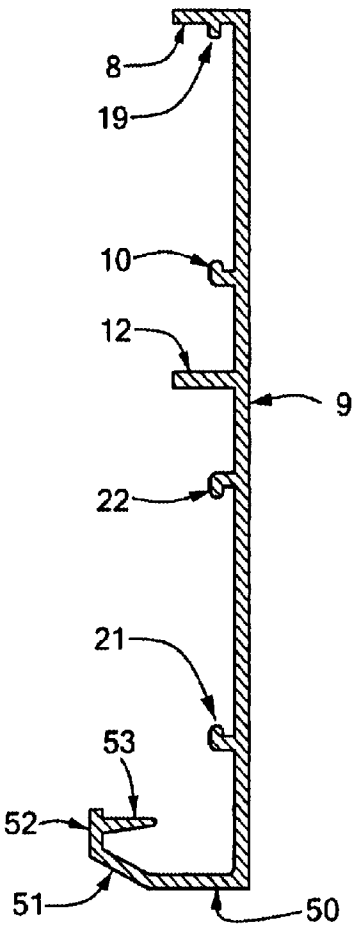
FIGS. 6*a*, 6*b*, 6*c* and 6*d* show cross sections of taut fabric support profiles, four embodiments of the extreme portions of these profile provided with means for keeping the false ceiling fabric tensioned.
Figure 6C:
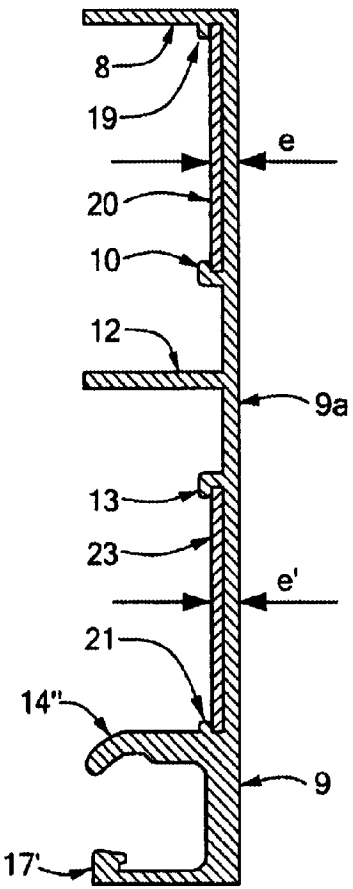
Figure 6B:
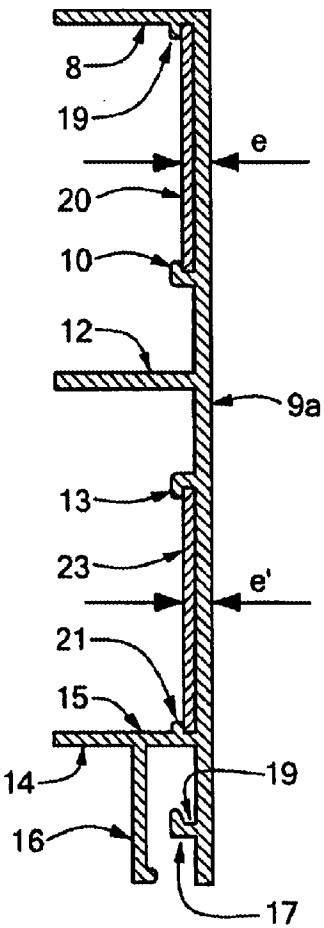
Figure 6A:
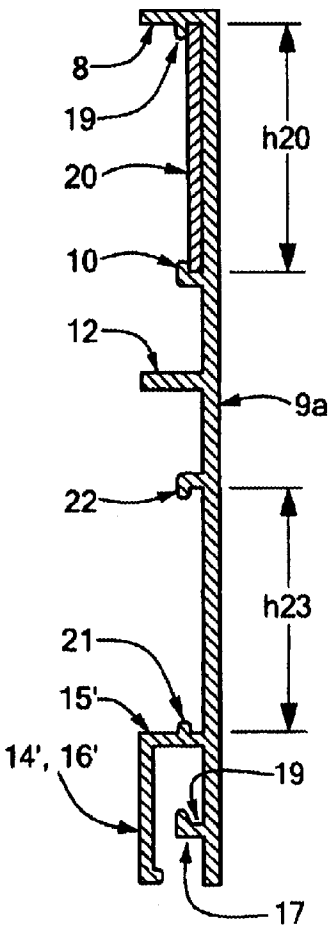

The housing 20 of these plates is shown on FIGS. 6*a* and 6*b*.

The wall 15 of the fourth projection 14 is provided with a rib 21 distant from the main wall by a value e' approximately equal to the opening of the groove 22 defined by the third projection 13.

This arrangement allows the sliding mounting on the profile 5 of plates whose edges have a thickness less than or equal to e, these plates at least partly marrying the internal shape of the profiles 5 between the wall 15 and the groove 22.

The housing 23 of these plates is shown on FIG. 6*b*.

In the embodiment of FIGS. 1, 2, 6*a* and 6*b*, the values e and e' are approximately equal and the heights h20 and h23 of the housings 20 and 23 are approximately equal.

In other embodiments (not shown), the values e and e' are different and/or the heights h20 and h23 are also different.

The plates inserted in the housings 20 and 23 may in particular have two functions.

Figure 4:
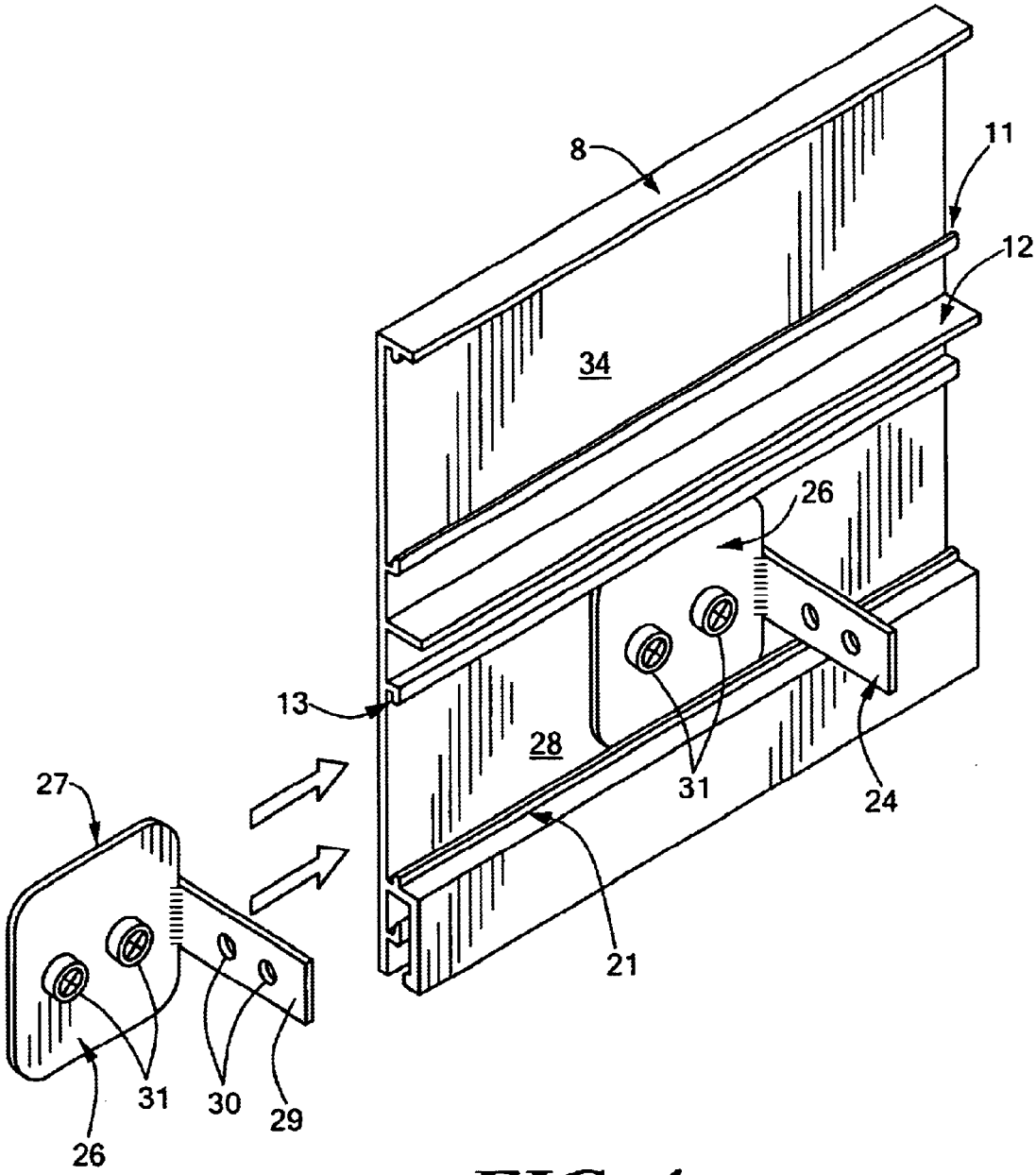
FIG. 4 is a detailed view showing the placing of the rail support means on the support profiles of the taut fabric in one embodiment.

A first function shown on FIGS. 1, 2 and 4 is the support function 24 for the rails or side rails.

Figure 5:
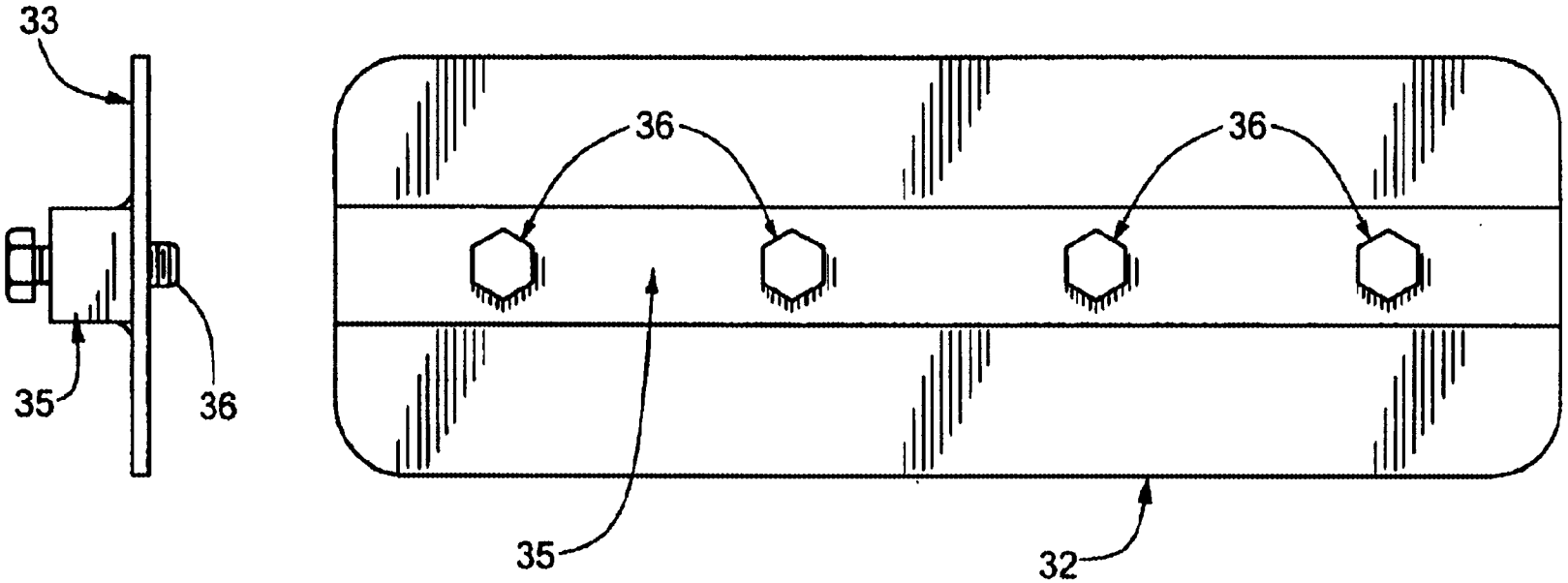
FIG. 5 is a detailed view of the means for mounting curved support profiles of the taut fabric in one embodiment.

A second function corresponding to FIG. 5 is the linking device function between the extreme portions of two continuous profiles 5 of the frame 2.

In the embodiment of FIGS. 1, 2 and 4, the supports 24 are arranged in the housing 23 and include a plate 26 whose external face 27 marries the shape of the internal face 28 of the profile 5 between the third projection 13 and the rib 21.

This plate 26 is provided with a bracket 29 pierced with fixing holes 30, this bracket 29 extending approximately perpendicular to the plate 26.

By means of riveting, screwing or bolting through the holes 30, the rails or side rails are rendered integral with the plates 26 fixed in position with respect to the profile 5.

The keeping of the plates 26 in position with respect to the profile can be obtained by welding or jamming in the housing 23 by screw spacers 31.

In the embodiment of FIG. 5, the linking means include a plate 32 whose external face 33 marries the shape of the internal face 34 of the profile 5 between the projection 19 of the support groove 11.

This plate 32 is provided with threaded traversing holes fitted in a central rib 35. Screws 36 thus allow the plate 32 to be locked in the housing 20.

This plate 32 can reinforce the link by butt welding the border profiles.

The plates 32 can be at least partly placed in the housings 23.

In the embodiment shown, the height hp of the profiles is such that two housings 20 and 23 can be provided for the support plates 26 and the mounting plates 32.

This profile height hp moreover allows the placing on the trellis of the rails and side rails of a heat insulating material

100 (FIG. 1A) and/or a sound insulating material such as a porous or fibrous material of any known type, this heat insulating material and sound insulation material remaining invisible to the naked eye and being placed at a predetermined adjustable distance from the fabric 1.

In other embodiments (not shown), the height hp of the profiles is such that a single slide inside the profile forms an insertion housing via the sliding of the support plates 24 and the mounting plates 32.

The extreme lateral portions of the rails and side rails rest against the wall 15 of the fourth projection 14.

In the embodiment of FIGS. 1, 2 and 6*b*, the girders of the rails and/or the side rails are assembled on the walls 15 by riveting or any other equivalent means.

In the embodiment of FIG. 6*a*, the fourth projection 14' has the general shape of an L and not a T and includes a wall 15' approximately perpendicular to the main wall 9 of the profile 5 and a wall 16' approximately opposite this main wall 9. In this variant, the trellis of the rails and side rails is not riveted to the wall 15' but can be welded to it.

The shapes of the profiles shown as cross sections on FIGS. 6*a* and 6*b* can be used together for embodying the lateral edge of the frame, the profile 6*a* being more specifically adapted to the curved portions of the frame, the profile 6*b* being more adapted to the rectilinear portions of this frame.

The edges of the fabric 1 can be fixed by hooking or support on a stop of the border profiles. In the embodiment of FIG. 1A, the hooking means of the fabric 1 are kept in support in the fifth projection 17, the lower edge of the wall 16 forming an angular member for the fabric 1.

Other embodiments of the means for retaining tension of the fabric 1 are shown on FIGS. 6*c* and 6*d*.

FIG. 6*c* shows a side edge profile 5 of the frame 2 whose extreme fabric hooking edge includes a curved projection 14" opposite a hooking rivet 17'.

FIG. 6*d* shows a diagram of another embodiment of the hooking means of the taut fabric. The hooking portion of the profile includes:

a bottom wall 50 approximately perpendicular to the main wall;

a section 51 slanted with respect to the bottom wall 50 and defining with the latter an angle of between several degrees and about 45 degrees;

an edge 52 approximately parallel to the main wall 9;

a projection 53 approximately perpendicular to the edge 52.

Depending on the shape of the hooking means, the taut fabric could be rendered flush with respect to the extreme edge of the profiles 5 or be placed standing back inside the frame 2.

Figure 3:
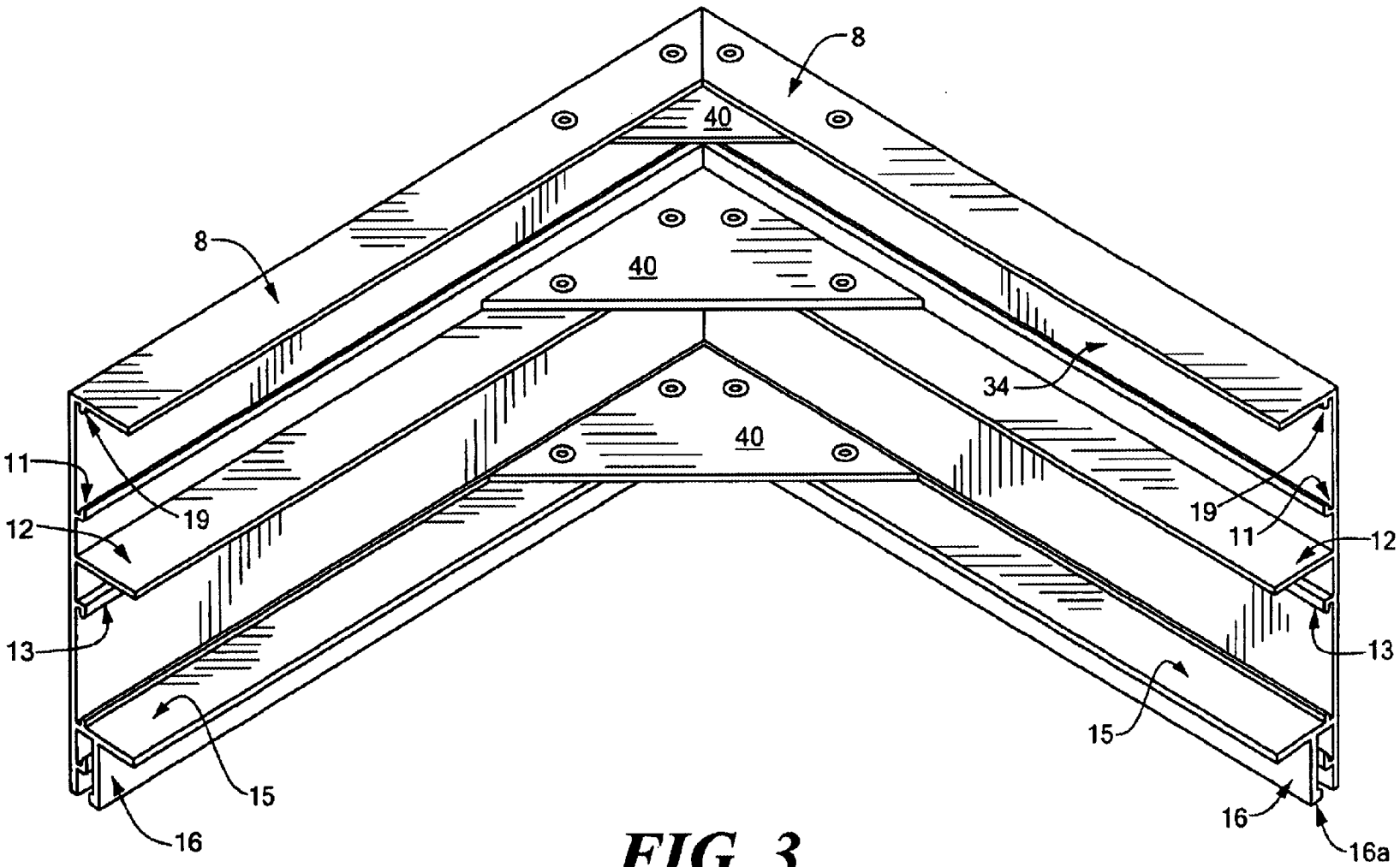
FIG. 3 is a detailed view of means for mounting at a right angle support profiles for the taut fabric according to one embodiment.

The frame profiles, if required, can be assembled at a right angle as shown on FIG. 3, angle reinforcements 40 mounted on the projections of the profiles being as a support for screwing, riveting or welding.

Thus, a frame with a rectangular or square contour can be obtained.

More generally, by adjusting the cut of the ended profiles, it is possible to obtain a frame with a polygonal contour.

The frame with a taut fabric described above makes it possible to embody elements of suspended false ceilings or false walls whose contours include curved, concave or convex sections.

For example, it is therefore possible to embody approximately flat taut false suspended ceiling elements and in the shape of disk or rings.

Figure 1E:
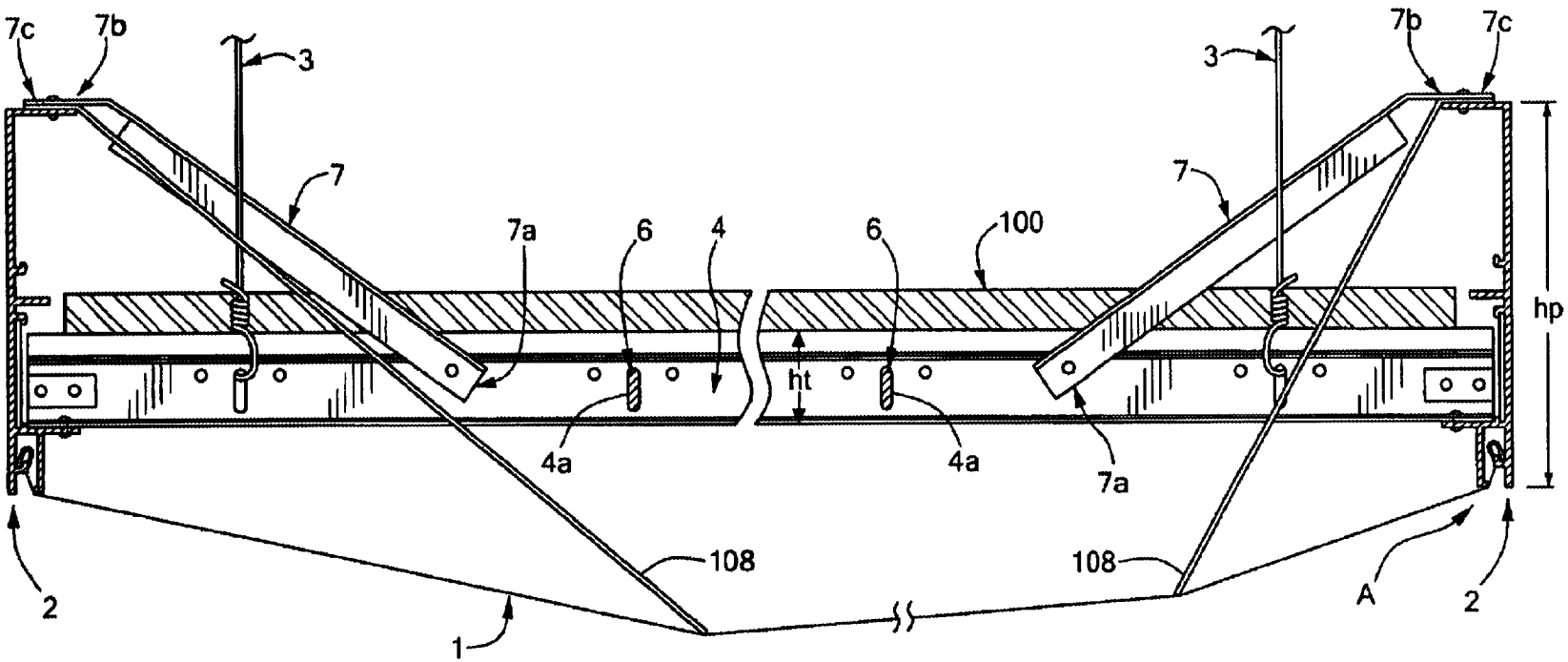
FIG. 1E is a cutaway view of another embodiment of a suspended false ceiling, including bars used to the deform the taut fabric of the suspended false ceiling.

These suspended taut false ceiling elements may further include means for deforming the fabric along a direction perpendicular or slanted with respect to the frame. These deformations means are, for example as shown in FIG. 1E, bars 108 joined to the frame 2 and exerting local pressure on the taut fabric 1. This pressure can be adjusted by an indexed mounting of said bars on the rails or side rails. The three dimensional effects obtained shall be varied according to the shape of the support surfaces of the bars on the fabric in particular.

Several elements of these suspended taut ceilings can be placed at identical heights or different heights, their contours being possibly complementary like the parts of a puzzle.

Thus as mentioned earlier, chains or any other equivalent suspension device enable the frame to be suspended with respect to the building structure.

If required, these suspension means allow the frame to be adjusted with respect to the structure of the building.

Of course, as a variant, it may be desired to fix permanently the taut false ceiling element to the body of the building, on a ceiling, a wall or any other wall.

It is possible to have a wide variety of the shapes of the suspended taut false ceiling elements described above inside the plane and the space available.

These shape variations combined with variations of tints, colours and finishings of the taut fabric enable these elements to be adapted to the varied layout of extremely large areas, such as commercial galleries, airports, factories and warehouses.

What is claimed is:

1. A false partition element comprising:

a frame comprising at least one profile, each profile having an attachment projection and a lateral edge, the lateral edge of at least one profile being curved along at least a portion thereof;

a fabric stretched inside the frame, at least one edge of the fabric having an attachment element co-operating with the attachment projection to attach the fabric to the profile, wherein a visible portion of the stretched fabric has a shape defined at least in part by the curve of the lateral edge of the profile; and a stiffening element attached to at least one of the plurality of rails and to an upper extremity sole of the profile;

wherein said frame further comprises a plurality of rails mounted approximately perpendicular to the profile.

2. The false partition element according to claim 1, wherein the stiffening member is chosen from a group comprising a beam, a strut, a tumbucide and a tightening trundle.

3. A false partition element comprising:

a frame comprising at least one profile, each profile having an attachment projection and a lateral edge, the lateral edge of at least one profile being curved along at least a portion thereof; and a fabric stretched inside the frame, at least one edge of the fabric having an attachment element co-operating with the attachment projection to attach the fabric to the profile, wherein a visible portion of the stretched fabric has a shape defined at least in part by the curve of the lateral edge of the profile;

wherein the profile includes a main wall having a plurality of extensions oriented inward of the profile, said plurality of extensions comprising:

an upper extreme sole, a first L-shaped projection, when seen as a cross section, the first L-shaped projection forming, with the main wall, a first support groove with an opening oriented towards the upper extreme sole, a second projection approximately perpendicular to the main wall, a third L-shaped projection, when viewed as a cross section, the fourth a fourth T-shaped projection, when viewed as a cross section, the fourth projection comprising a first wall approximately perpendicular to the main wall and a second wall approximately parallel to the main wall, and the attachment projection.

4. The false partition element according to claim 3, wherein said upper extreme sole comprises a projection approximately parallel to the main wall and a spaced apart from the main wall by a first distance, thereby defining a first housing to slideably accept a first profile plate whose thickness is less than or equal to the first distance between the upper extreme sole and the first support groove.

5. The false partition element according to claim 4, wherein the first wall of the fourth projection includes a rib spaced apart from the main wall by a second distance approximately equal to a size of an opening of a second support groove defined by the third projection, thereby defining a second housing to slideably accept a second profile plate whose thickness is less than or equal to the second distance.

6. The partition element according to claim 5, wherein the first distance approximately equals the second distance and a height of the first housing approximately equals a height of the second housing.

7. The false partition element according to claim 6, further comprising first and second profile plates respectively introduced into the first and second housings.

8. The false partition element according to claim 7, further comprising:

a plurality of rails mounted approximately perpendicular to the profile; and a plurality of rail supports, each comprising:

a main plate whose external face marries a shape of an internal face between the third projection and the rib, and a bracket extending approximately perpendicular to the main plate and attached to at least one of the plurality of rails.

9. The false partition element according to claim 7, wherein at least one of the first and second profile plates has an external face that marries a shape of an internal face of the profile and at least one threaded hole, each threaded hole being fitted with a screw for locking the profile plate to the profile.

10. The false partition element according to claim 4, wherein the first wall of the fourth projection includes a rib spaced apart from the main wall by a second distance approximately equal to a size of an opening of a second support groove defined by the third projection, thereby defining a second housing to slideably accept a second profile plate whose thickness is less than or equal to the second distance.

11. The false partition element according to claim 8, wherein at least one of the first and second profile plates has an external face that marries a shape of an internal face of the profile and at least one threaded hole, each threaded hole being fitted with a screw for locking the profile plate to the profile.

12. A false partition element comprising:

a frame comprising at least one profile, each profile having an attachment projection and a lateral edge, the lateral edge of at least one profile being curved along at least a portion thereof; and a fabric stretched inside the frame, at least one edge of the fabric having an attachment element co-operating with the attachment projection to attach the fabric to the profile, wherein a visible portion of the stretched fabric has a shape defined at least in part by the curve of the lateral edge of the profile; and wherein:

said frame further comprises a plurality of rails mounted approximately perpendicular to the profiles;

said frame further comprises a plurality of side rails, the rails and side rails forming a trellis;

said rails define openings passed through by said side rails;

the profile includes a main wall having a plurality of projections oriented inward of the main wall;

the rails extend up to a height less than a height of the profile, whereby the rails and side rails are hidden from view by the profile;

said frame further comprises a stiffening element attached to at least one of the plurality of rails and to an upper extremity side of the profile, said stiffening element being slanted with respect to plane of the fabric and chosen from the group, comprising beams, struts, turnbuckles and tightening trundles.

13. The false partition element according to claim 12, wherein the frame is adjustably attached to a building ceiling and attached to a building wall.

14. The false partition element according to claim 12, further comprising:

a second frame comprising at least one second profile having an attachment projection and a lateral edge; and a second fabric stretched inside the second frame, at least one edge of the second fabric having an attachment element co-operating with the attachment projection to attach the second fabric to the second profile; and wherein at least one of the first or second frames is attached to a building wall.

15. A false partition element comprising:

a frame comprising at least one profile, each profile having an attachment projection and a lateral edge, the lateral edge of at least one profile being curved along at least a portion thereof; and a fabric stretched inside the frame, at least one edge of the fabric having an attachment element co-operating with the attachment projection to attach the fabric to the profile, wherein a visible portion of the stretched fabric has a shape defined at least in part by the curve of the lateral edge of the profile; and wherein:

the profile includes a main wall having a plurality of projections oriented inward of said main wall, said plurality of projections comprising:

an upper extreme sole, a first L-shaped projection, when seen as a cross section, the first L-shaped projection forming, with the main wall, a first support groove with an opening orientated towards the upper extreme sole, a second projection approximately perpendicular to the main wall, a third L-shaped projection, when viewed as a cross section, a fourth T-shaped projection, when viewed as a cross section, the fourth projection comprising a first wall approximately perpendicular to the main wall and a second wall approximately parallel to the main wall, the attachment projection, said upper extreme sole comprises a projection approximately parallel to the main wall and spaced apart from the main wall by a first distance, thereby defining a first housing to slideably accept a first profile plate whose thickness is less than or equal to the first distance between the upper extreme sole and the first support groove;

the first wall of the fourth projection includes a rib spaced apart from the main wall by a second distance approximately equal to a size of an opening of a second support groove defined by the third projection, thereby defining a second housing to slideably accept a second profile plate whose thickness is less than or equal to the second distance;

a height of the first housing approximately equals a height of the second housing;

further comprising first and second profile plates respectively introduced into the first and second housings, wherein at least one of the first and second profile plates has an external face that marries a shape of an internal face of the profile and at least one threaded hole, each threaded hole being fitted with a screw for locking the profile plate to the profile;

further comprising a plurality of rails mounted approximately perpendicular to the profile;

further comprising a plurality of rail supports, each comprising:

a main plate whose external face marries a shape of an internal face between the third projection and the rib, and a bracket extending approximately perpendicular to the main plate and attached to at least one of the plurality of rails.

16. The false partition element according to claim 15, wherein the frame is adjustably attached to a building ceiling and attached to a building wall.

17. The false partition element according to claim 15, further comprising:

a second frame comprising at least one second profile having an attachment projection and a lateral edge; and a second fabric stretched inside the second frame, at least one edge of the second fabric having an attachment element co-operating with the attachment projection to attach the second fabric to the second profile; and wherein at least one of the first or second frame is attached to a building wall.

* * * * *

UNITED STATES PATENT AND TRADEMARK OFFICE

CERTIFICATE OF CORRECTION

PATENT NO. : 6,880,302 B1
DATED : April 19, 2005
INVENTOR(S) : Marc Fontaine

It is certified that error appears in the above-identified patent and that said Letters Patent is hereby corrected as shown below:

Title page,
Item [22], PCT Filed, delete "May 20, 2000" and insert -- March 20, 2000 --.

Signed and Sealed this

Eighteenth Day of October, 2005

JON W. DUDAS
*Director of the United States Patent and Trademark Office*